US008146627B2

(12) United States Patent
Mazur

(10) Patent No.: US 8,146,627 B2
(45) Date of Patent: Apr. 3, 2012

(54) EASY LOAD PILLBOX AND LOADING TRAY

(76) Inventor: Robert Mazur, Canton, MI (US)

( * ) Notice: Subject to any disclaimer, the term of this patent is extended or adjusted under 35 U.S.C. 154(b) by 1080 days.

(21) Appl. No.: 12/033,332

(22) Filed: Feb. 19, 2008

(65) Prior Publication Data

US 2009/0206100 A1 Aug. 20, 2009

Related U.S. Application Data

(60) Provisional application No. 60/609,759, filed on Feb. 16, 2007.

(51) Int. Cl.
*B65B 1/04* (2006.01)
*B65D 83/04* (2006.01)

(52) U.S. Cl. ..... 141/247; 141/240; 206/533; 206/534; 206/538; 220/504

(58) Field of Classification Search ..... 141/2, 18, 141/237–240, 247, 319, 320, 391; 206/528, 206/533, 534, 538, 539; 220/503, 504
See application file for complete search history.

(56) References Cited

U.S. PATENT DOCUMENTS

| | | | | | |
|---|---|---|---|---|---|
| 3,225,913 | A * | 12/1965 | Lee | 206/534 |
| 3,817,372 | A * | 6/1974 | Smith | 206/539 |
| 4,253,572 | A * | 3/1981 | Halbich | 206/538 |
| 4,793,492 | A * | 12/1988 | Halbich | 206/538 |
| 6,761,010 | B1 * | 7/2004 | Gibson | 53/390 |
| 6,779,663 | B1 * | 8/2004 | Pocsi | 206/534 |
| 7,004,324 | B1 * | 2/2006 | Delorio | 206/570 |
| 7,228,970 | B2 * | 6/2007 | Holmberg | 206/534 |
| 7,387,207 | B2 * | 6/2008 | Priebe et al. | 206/532 |
| 7,494,012 | B1 * | 2/2009 | Priebe et al. | 206/538 |
| 7,828,148 | B2 * | 11/2010 | Gibson | 206/534 |
| 2007/0181614 | A1 * | 8/2007 | Rvachov et al. | 222/456 |

* cited by examiner

*Primary Examiner* — Gregory Huson
*Assistant Examiner* — Nicolas A Arnett
(74) *Attorney, Agent, or Firm* — Brinks Hofer Gilson & Lione

(57) ABSTRACT

Modular pillboxes that include at least one one-way passage through which pills, materials or other articles can be pushed through and into and underlying interior compartment of the modular pillboxes. The modular pillboxes include coupling structure by which the modular pillbox can be coupled to a loading tray and/or additional modular pillboxes. The modular pillboxes include lids that can be opened to access pills, materials or other articles that are loaded therein through the one-way passages.

20 Claims, 16 Drawing Sheets

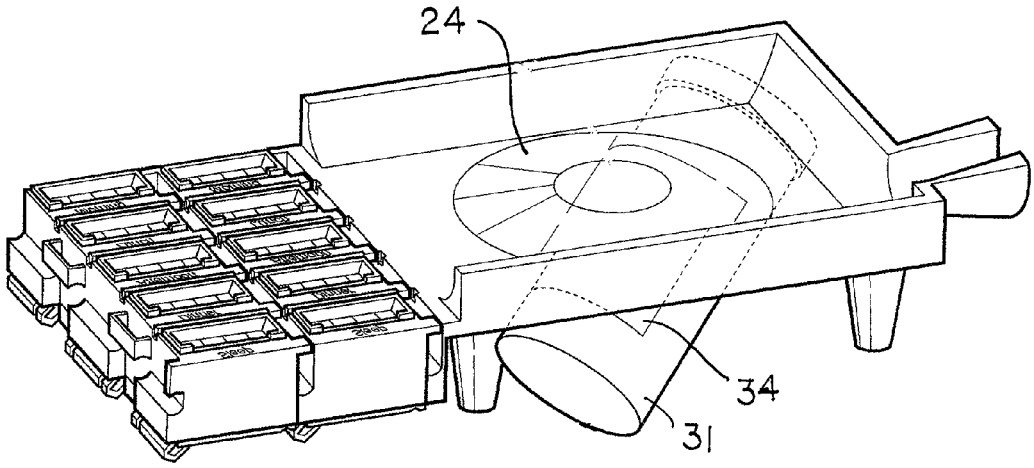
FIG - 29
FIG - 30
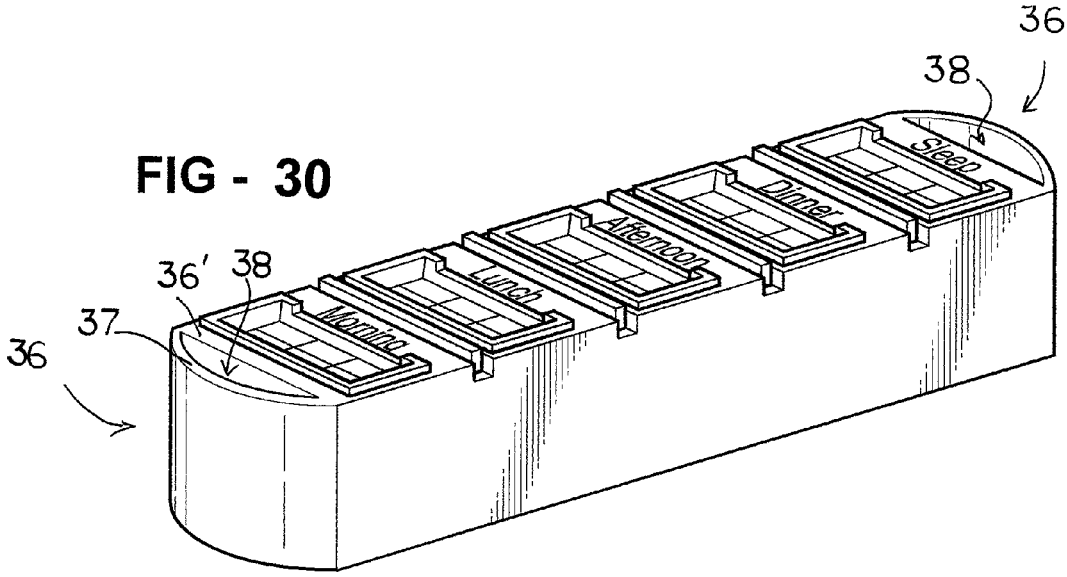

EASY LOAD PILLBOX AND LOADING TRAY

RELATED APPLICATION

This application is based on and claims priority under 35 U.S.C. §120 to U.S. provisional patent application Ser. No. 60/609,759, filed Feb. 16, 2007, the complete disclosure of which is hereby expressly incorporated by reference.

TECHNICAL FIELD

The present invention relates to pillboxes in which medication and other materials or articles can be loaded for subsequent dispensing at various times.

BACKGROUND ART

There are several commercially available pillboxes that comprise multi-compartment containers with individual lids for each compartment. Consumers load such pillboxes with medicines such as pills, tablets, capsules, etc. by retrieving such medicine from containers and placing one or more pills, tablets, capsules, etc. in each of the individual compartments of the pillboxes and thereafter closing the lids. This loading procedure is somewhat awkward and typically requires excessive handling or the pills, tablets, capsules, etc.

The present invention provides pillboxes that are designed to be easily loaded with a loading tray that avoids excessive handling of pills, tablets, capsules, etc. that are to be loaded in individual compartments of the pillboxes.

DISCLOSURE OF THE INVENTION

According to various features, characteristics and embodiments of the present invention which will become apparent as the description thereof proceeds, the present invention provides a modular pillbox which includes a housing having at least one interior compartment defined by a top, an openable lid which closes the top, a bottom that comprises a one-way passage through which pills can be pushed into the interior compartment, and sidewalls.

The present invention further provides a modular pillbox and loading system that comprises:

at least one modular pillbox which comprises a housing having at least one interior compartment defined by a top, an openable lid which closes the top, a bottom that comprises a one-way passage through which pills can be pushed into the interior compartment, and sidewalls, and a loading tray having a loading deck, the at least one modular pillbox and the loading tray including coupling structure by which the at least one modular pillbox can be coupled to the loading tray immediately adjacent to the loading deck with the one-way passage facing upward.

The present invention further comprises a method of loading pills into a pillbox which involves:

providing a pillbox that has an interior compartment, an openable lid and a one-way passage through which pills can be pushed into the interior compartment;

positioning a pill on the one-way passage; and pushing the pill through the one-way passage and into the interior compartment.

BRIEF DESCRIPTION OF DRAWINGS

The present invention will be described with reference to the attached drawings which are given as non-limiting examples only, in which:

FIG. 13 is a perspective view of a two-dimensional array of modular pillboxes aligned with the coupling structures of a loading tray. FIG. 14 is a perspective view of the two-dimensional array of modular pillboxes coupled to the loading tray. FIG. 15 is a bottom planar view of the two-dimensional array of modular pillboxes coupled to the loading tray. FIG. 16 is a top planar view of the two-dimensional array of modular pillboxes coupled to the loading tray.

FIG. 29 depicts how a magnifying lens provided in the loading tray can be used to read a label of a medicine bottle.

FIG. 30 depicts a modular pillbox that includes a linear array of five pill compartments.

BEST MODE FOR CARRYING OUT THE INVENTION

The present invention is directed to modular pillboxes that are configured to be coupled together in various configurations and are further configured to allow easy loading of pills into the individual interior compartments of the modular pillboxes. Each modular pillbox includes one or more hinged lid on one side, preferably an upper side that can contain indicia such as information that can be printed, molded, applied (e.g. as a label), or provided on the hinged lid in any suitable manner. On another side, preferably the lower side, of each modular pillbox is provided with a resilient, elastic, deflectable or flexible member below each interior compartment that is configured to allow materials, pills or other articles to be passed therethrough and into the interior space of the individual modular pillboxes. For example, the resilient, elastic, deflectable, or flexible members can be provided with one or more slits though which materials, pills or other articles can be passed. In other embodiments, the resilient, elastic, deflectable or flexible member can comprise a flap that will yield to allow materials, pills or other articles can be passed therethrough. The flap can comprise a non-overlapping structure or an overlapping structure.

The side, or a portion thereof, of the modular pillboxes that are provided with the resilient, elastic, deflectable or flexible member can also be provided with indicia such as information that can be printed, molded, applied (e.g. as a label), or provided on the hinged lid in any suitable manner. This indicia, as will be further understood, can be useful in "loading" the modular pillboxes, as one verifies that the proper modular pillbox is being loaded with a desired material, pill(s) or other article(s).

The modular pillboxes are configured to be removably joined or coupled together in various configurations, including one- and two-dimensional arrays. In this regard one or more sides of each modular pillbox includes cooperating coupling structure(s) such as grooves, protrusions, tabs, slots, snap-fit or press-fit structures, snaps, Velcro, releasable adhesive, etc. In further embodiments, the modular pillboxes can be coupled together by auxiliary pins, clips, etc. It is also within the scope of the present invention to join or couple the modular pillboxes together with twist and lock structures such as bayonet coupling structures. The modular pillboxes can comprise single individual interior compartments or linear banks or sets of two or more interior compartments.

The present invention also provides a loading tray which has a loading deck that is configured to be coupled to one or more of the modular pillboxes. According to one embodiment the loading tray can be provided with a magnifying lens for reading labels of medicine bottles or other labels, instructions, warnings, etc. The loading tray can also include a handle and/or a funnel for handling or dispensing different materials.

Figure 1:
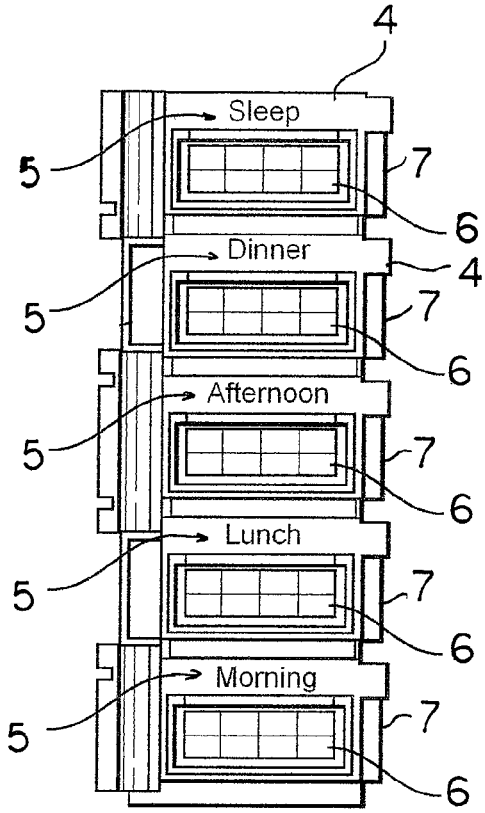
FIG. 1 is a bottom planar view of a modular pillbox according to one embodiment of the present invention.

FIG. 1 is a bottom planar view of a modular pillbox according to one embodiment of the present invention. In FIG. 1 the modular pillbox comprises four interior compartments 1 (See FIG. 5) that are separated by interior walls 2 (See FIG. 5). The periphery of the modular pillbox is defined by exterior walls 3 (See FIG. 5). Adjacent the bottom of each of the interior compartments is a support surface 4 upon which indicia 5 such as information that can be printed, molded, applied (e.g., as a label), or otherwise be provided. The bottoms of the interior compartments 1 comprise resilient, elastic, deflectable or flexible members 6 that can comprise a flap that will yield to allow materials, pills or other articles can be passed therethrough, as discussed in more detail below. Reference herein to "pill" or "pills" is intended to include and encompass tablets, capsules, gel caps, gummy gels and other types and/or carriers of medicines, vitamins and health supplements. One side of the modular pillbox is provided coupling structure(s) 7 as discussed above and shown more clearly in FIG. 2.

Figure 2:
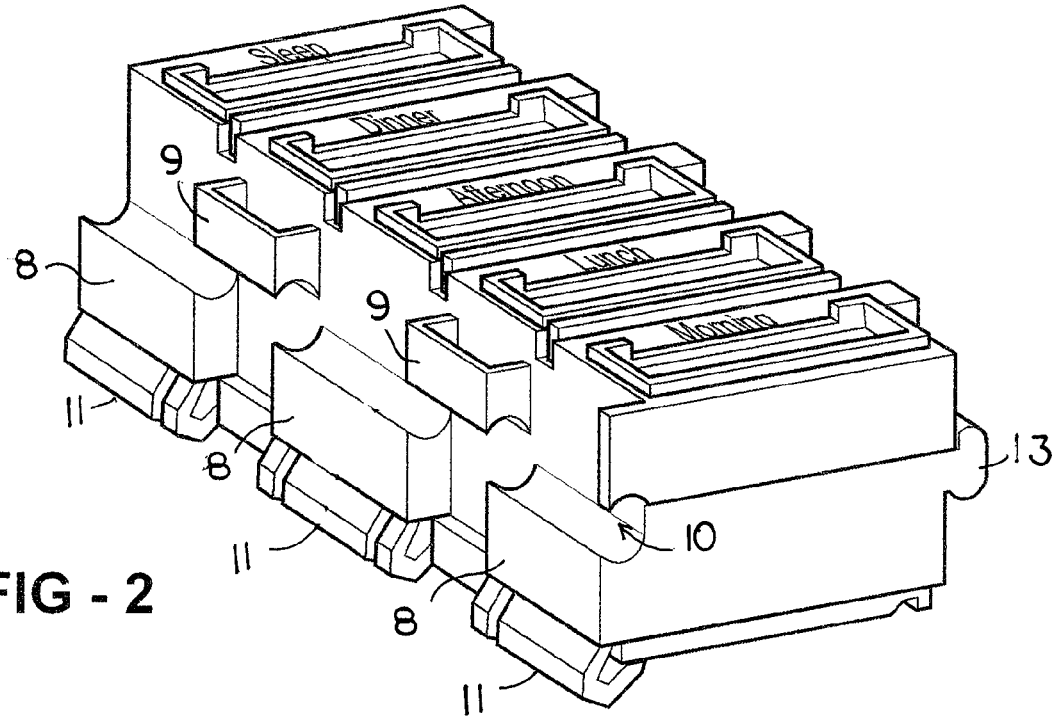
FIG. 2 is a perspective view of the modular pillbox of FIG. 1.

FIG. 2 is a perspective view of the modular pillbox of FIG. 1. In FIG. 2 a series of projecting structures 8 and 9 which are off-set and define therebetween a groove or channel 20 that extend along the side of the modular pillbox. As will be understood as the description of the invention proceeds, the coupling structure(s) is not limited to the illustrative embodiment depicted in FIG. 2. Also, it is noted that whereas discrete projecting structures 8 and 9 are shown in FIG. 2, the groove or channel 10 can be defined between opposed continuous projecting structures. In FIG. 2 the hinges 11 that pivotally couple the lids 12 (See FIG. 4) to close the individual interior compartments 1 as shown. Also shown in FIG. 2 is a protrusion 13 on the opposite side (from the projecting structures 8 and 9) that is complementary shaped and sized to be received in a groove or channel 10 of another modular pillbox (See FIG. 13).

Figure 3:
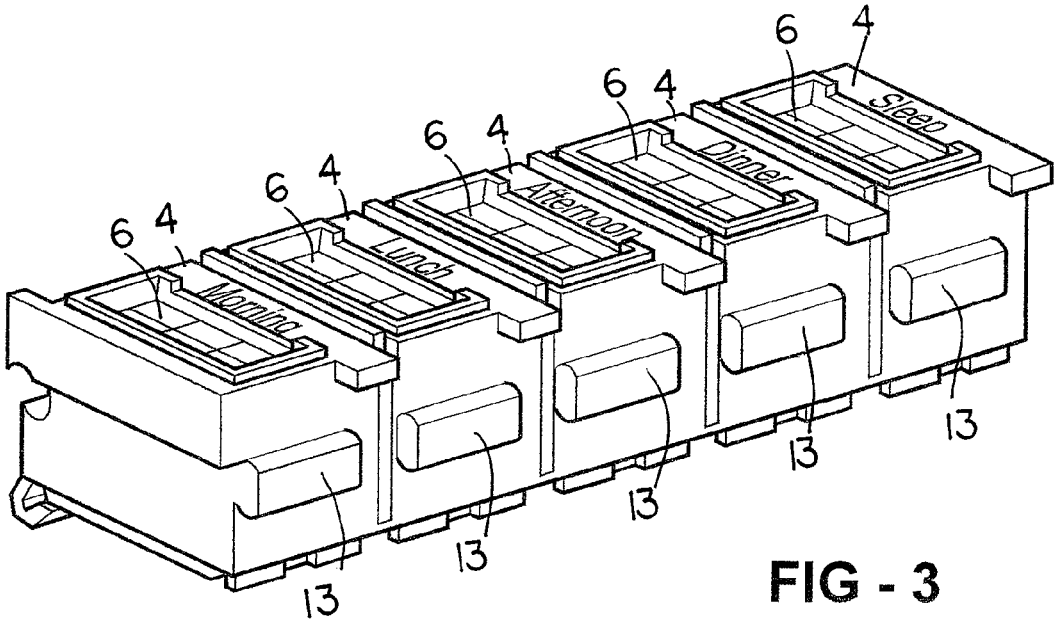
FIG. 3 is a perspective view of the modular pillbox of FIG. 2, showing another side of the modular pillbox.

FIG. 3 is a perspective view of the modular pillbox of FIG. 2, showing another side of the modular pillbox. FIG. 3 shows that the protrusion 13 seen in FIG. 2 comprises a linear alignment of protrusions 13, it being understood that a single continuous protrusion could be provided rather than a linear alignment of discrete protrusions 13 as shown in FIG. 3. In the embodiment shown in FIG. 3 the support surfaces 4 upon which indicia 5 can be provided is depicted as extending over the side of the modular pillbox. In further embodiments the support surfaces 4 can extend coextensively with the width of the modular pillbox or even be shorter if desired.

Figure 4:
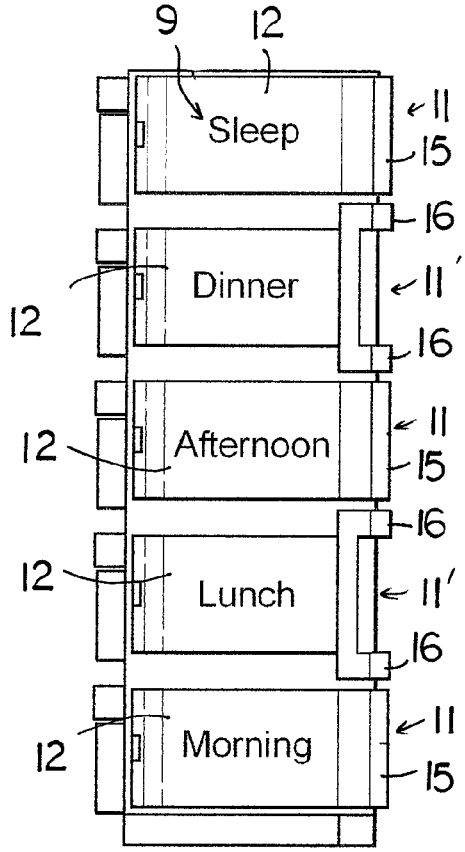
FIG. 4 is a top planar view of the modular pillbox of FIG. 1.

FIG. 4 is a top planar view of the modular pillbox of FIG. 1. In FIG. 4 the lids 12 of the individual interior compartments 1 are in their closed positions. As can be seen, the top surface of the lids 12 provide an area upon which indicia 14 such as information that can be printed, molded, applied (e.g., as a label), or otherwise be provided. In FIG. 4 two different types of hinges 11 and 11' are shown. Hinges 11 have a continuous center portion 15 about which the respective hinge/lid can pivot in a known manner. Hinges 11' have yoke shaped ends with protrusions 16 about which the respective hinge/lid can pivot in a known manner. It is to be understood that the design and configuration of the hinge can be varied as desired.

Figure 5:
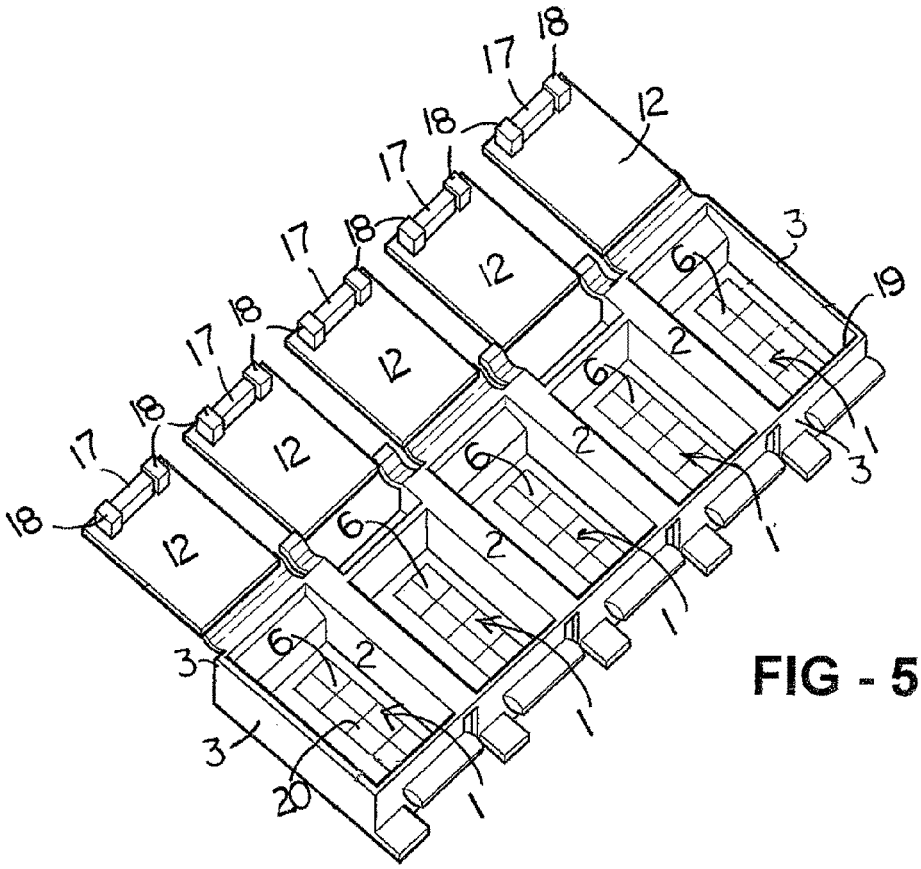
FIG. 5 a top perspective view of the modular pillbox of FIG. 1 with the lids of the interior compartments of the modular pillboxes opened.

FIG. 5 a top perspective view of the modular pillbox of FIG. 1 with the lids of the pillboxes opened. The free end of the lids 12 that are opposite the hinges 11 and 11' are provided with a locking mechanism 17 which, in the illustrated embodiment comprises a portion of material 18 that creates an interference fix with the exterior side wall 19 of the modular pillbox when the lid 12 is closed and provides a positive textural feel. It is also within the scope of the present invention to provide a detent locking mechanism that engages between the free end of the lid 12 and the exterior side wall 19 of the modular pillbox. It is likewise to provide a movable latch of any convenient design, like for example a slidable or pivotal latch or a pin that cooperates between the free end of the lid 12 and the exterior wall 19 of the modular pillbox. It is also within the scope of the present invention to utilize magnetic elements to help maintain the lids 12 in their closed positions The lids 12 can be made of any suitable transparent, translucent or opaque material or a material that prevents the transfer of light in certain directions. The lids 12 can be smooth or textured on the inside and/or out as desired to provide mechanical strength if desired or artistic in appearance. As depicted, the bottom of each of the interior compartments 1 comprises a resilient, elastic, deflectable or flexible member 6 that is configured to allow materials, pills or other articles to be passed therethrough and into the interior space of the individual modular pillboxes. For example, the resilient, elastic, deflectable, or flexible member 6 can be provided with one or more slits 20 though which materials, pills or other articles can be passed. In other embodiments, the resilient, elastic, deflectable or flexible member 6 can comprise a flap that will yield to allow materials, pills or other articles can be passed therethrough. The flap can comprise a non-overlapping structure or an overlapping structure.

The bottoms of each of the interior compartments allow materials, pills or other articles can be passed therethrough from the outside and prevent materials, pills or other articles within the interior compartments 1 from passing out through the bottoms under the influence of vibration, movement, shock, etc. of the modular pillboxes.

Figure 6:
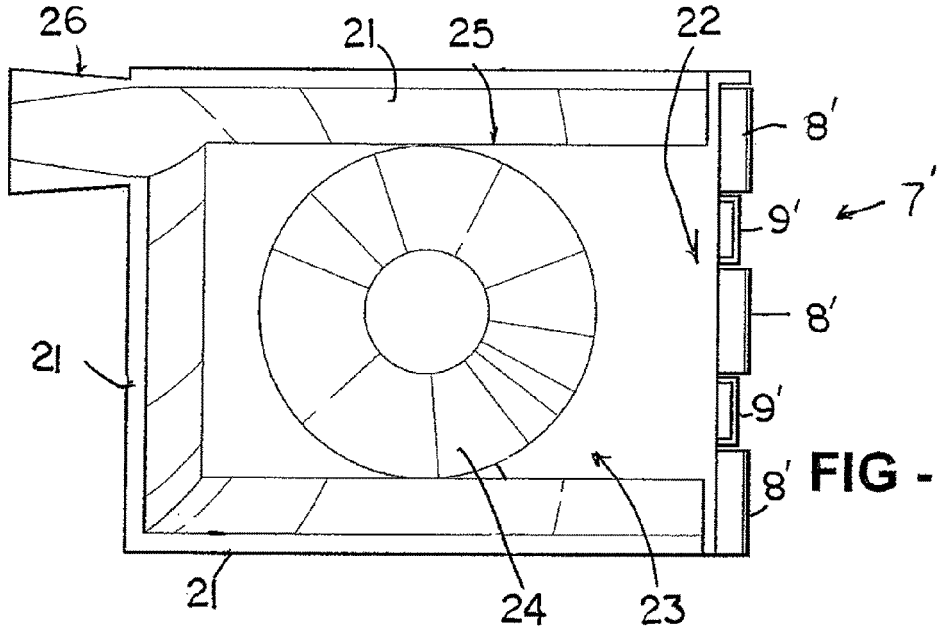
FIG. 6 is a top planar view of a loading tray according to one embodiment of the present invention.

FIG. 6 is a top planar view of a loading tray according to one embodiment of the present invention. The loading tray includes an upstanding peripheral wall 21 that surround three sides. The fourth side comprises the loading deck area 22 which is provided adjacent thereof with coupling structure 7' which is compatible and cooperates with the coupling structure 7 on the modular pillboxes so that one or more of the modular pillboxes can be coupled to the loading tray immediately adjacent the loading deck area 22. The central portion 23 of the loading tray is substantially flat and used for sorting materials, pills or other articles for dispensing in the modular pill boxes. In the illustrated embodiment, a magnifying lens 24 is formed in the central portion 23 of the loading tray. One side of the loading tray is provided with a trough or channel 25 that extends along the side and terminates into a funnel structure 26, which can also function as a handle for holding the loading tray. The function of the trough or channel 25 and funnel 26 will be discussed in more detail below.

Figure 7:
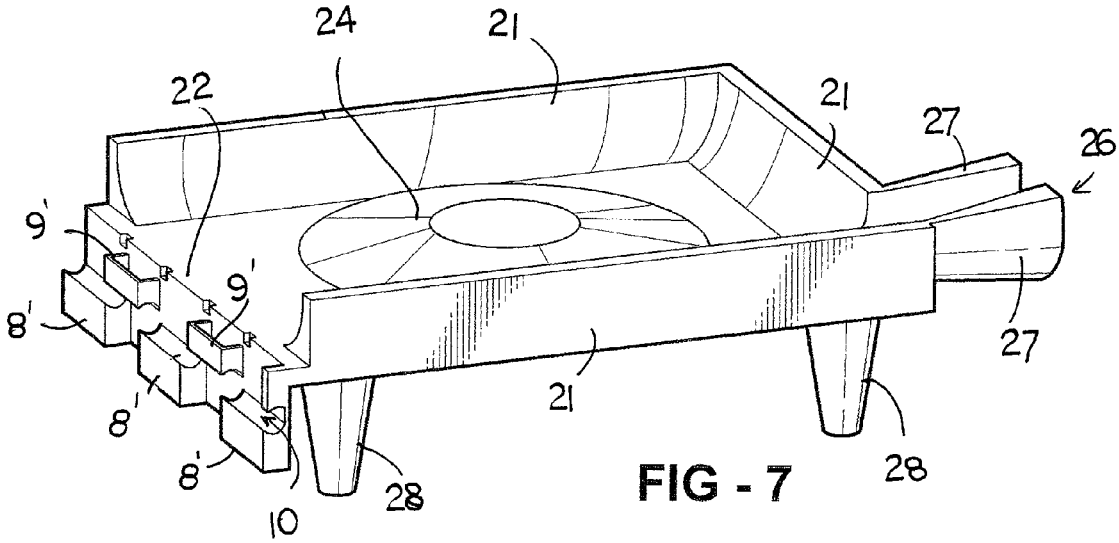
FIG. 7 is a perspective view of the loading tray of FIG. 6 showing the side of the loading deck.
Figure 8:
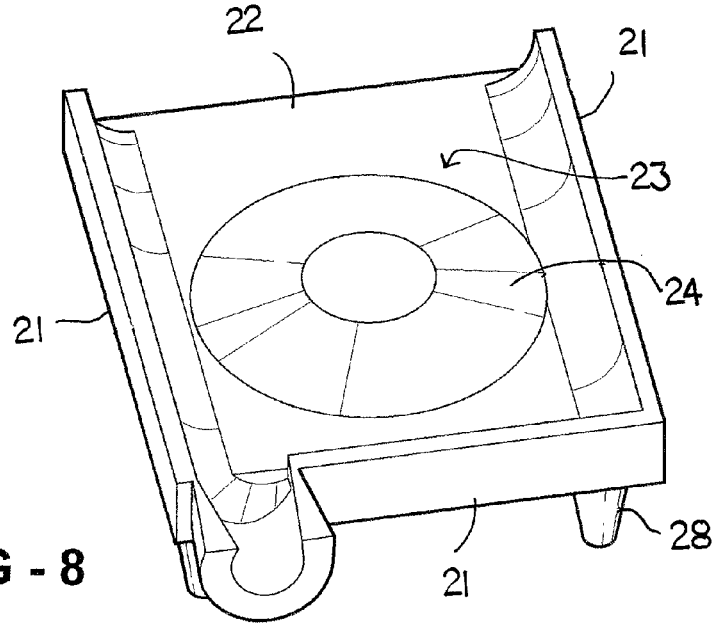
FIG. 8 is a perspective view of the loading tray of FIG. 6 showing an opposite side.
Figure 9:
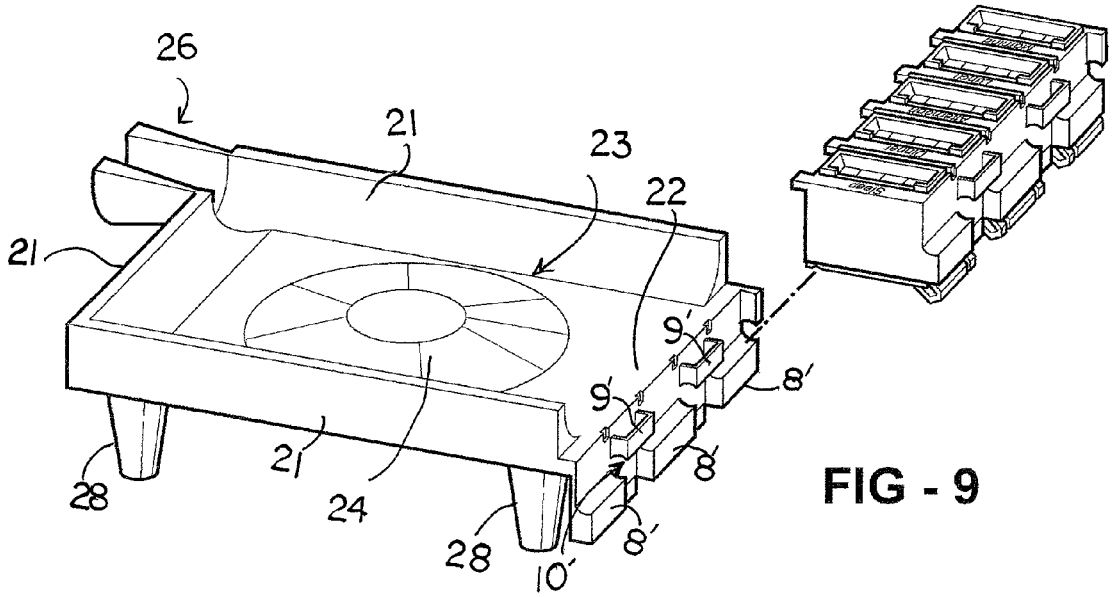
FIGS. 9-12 are a series of perspective views which depict how a group of coupled or joined pillboxes are coupled or joined to the loading tray adjacent the loading deck.

FIG. 7 is a perspective view of the loading tray of FIG. 6 showing the side of the loading deck. FIG. 8 is a perspective view of the loading tray of FIG. 6 showing an opposite side. In FIGS. 7 and 8 the peripheral walls 21 of the loading tray can be seen as having curved inner surfaces. Also shown is the manner in which the funnel 26 or handle is defined by contoured side walls 27 which are of the same height and continue from the adjacent peripheral side wall 21 of the loading tray. It is to be understood that the peripheral side walls 21 could also be sloped or planar and intersect the flat surface of the loading tray at 90° or any suitable angle. Also it is to be understood that the funnel 26 could have walls 27 that are taller or shorter than the peripheral walls 21 of the loading tray. Otherwise the funnel 26 could even have a closed top portion, if desired.

A plurality of legs 28 extend from the lower surface of the loading tray as shown. Also shown in FIG. 7 are a series of projecting structures 8' and 9' adjacent the loading deck 22 which are substantially identical to the series of projecting structures 8 and 9 shown and discussed above in reference to FIG. 2. This series of projecting structures 8' and 9' provides coupling structure 7' by which a modular pillbox can be coupled to the loading tray as discussed below. As will be understood as the description of the invention proceeds, the coupling structure(s) is not limited to the illustrative embodiment depicted in FIG. 7. Also, it is noted that whereas discrete projecting structures 8' and 9' are shown in FIG. 7, the groove or channel 10' can be defined between opposed continuous projecting structures.

Figure 10:
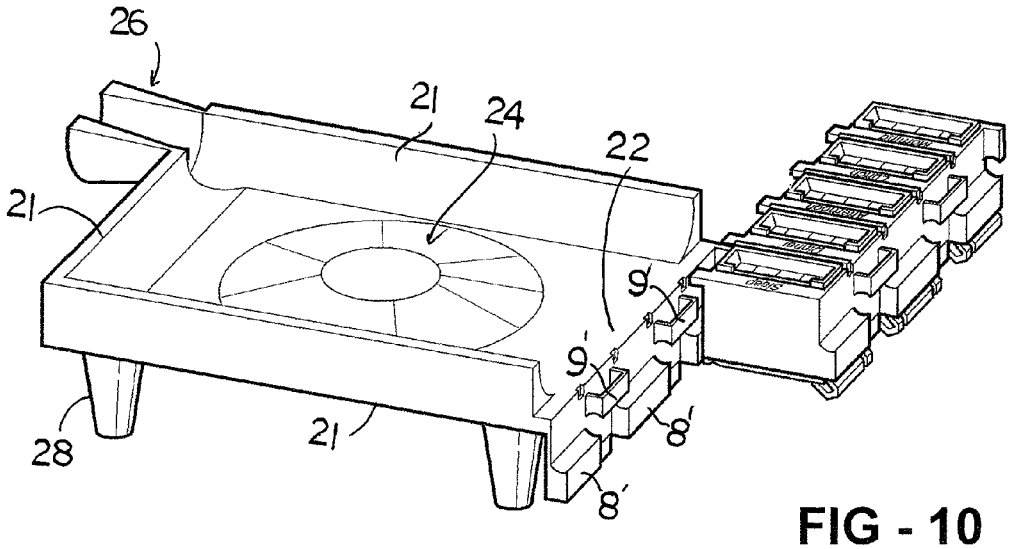
Figure 11:
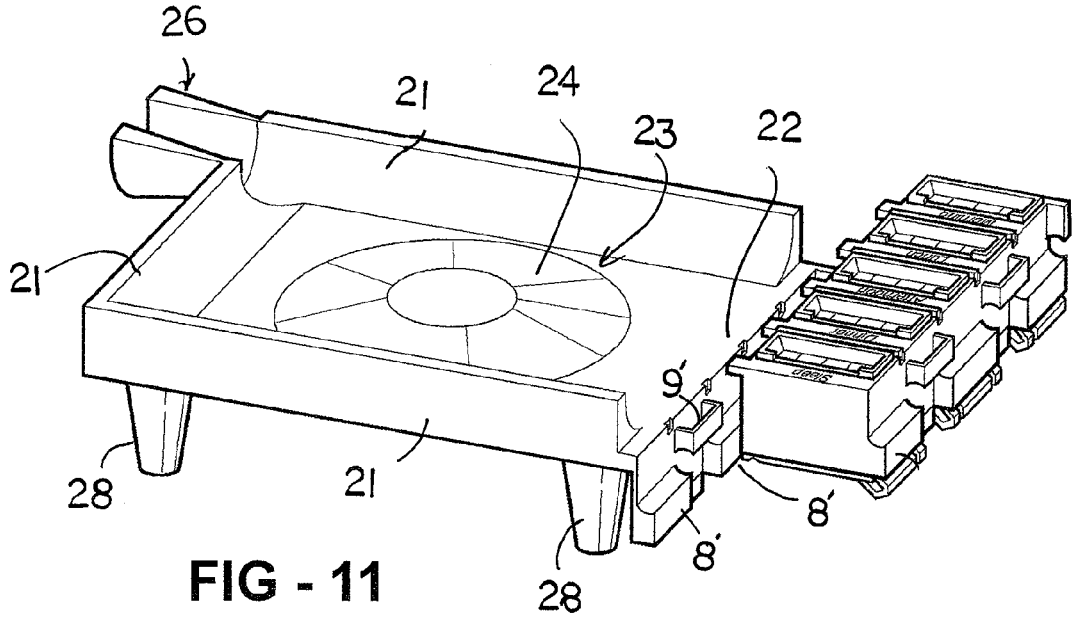
Figure 12:
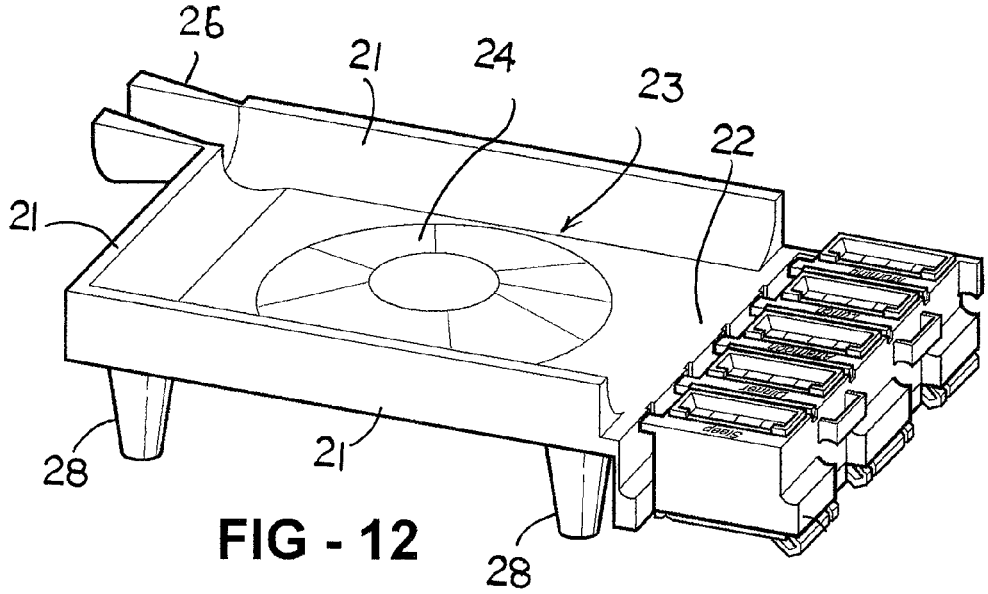

FIGS. 9-12 are a series of perspective views which depict how a group of coupled or joined pillboxes are coupled or joined to the loading tray adjacent the loading deck. In order to couple a modular pillbox to the loading tray the modular pillbox is oriented upside down so that the bottom of the modular pillbox having the resilient, elastic, deflectable or flexible members 6 over each interior compartment 1 is facing up. Next, the coupling structures 7 of the modular pillbox are aligned with the coupling structures 7' of the loading tray. In the illustrated example shown in FIGS. 9-12 the protrusions 13 provided on the side of the modular pillbox are aligned with the groove or channel 10' defined by the projecting structures 8' and 9' of the loading tray. In this alignment, the protrusions 13 provided on the side of the modular pillbox can be slid into the groove or channel 10' defined by the projecting structures 8' and 9' of the loading tray as shown in FIGS. 10-12. If desired, cooperating stopping structures such as abutments, detent mechanisms, etc. can be provided on the modular pillbox and loading tray to prevent the leading edge of the modular pillbox from sliding past a desired position of the loading tray. Alternatively, pins or clips can be provided to secure the modular pillbox in a desired location along the loading deck 22 of the loading tray. It is noted that that in further embodiments, the loading tray could be provided with projections that are received in a groove or channel 10 defined by the projecting structures 8 and 9 provided on the modular pillbox. Also, as noted above, the coupling structures are not specifically limited to the shape and configurations of those shown in FIGS. 9-12.

Figure 13:
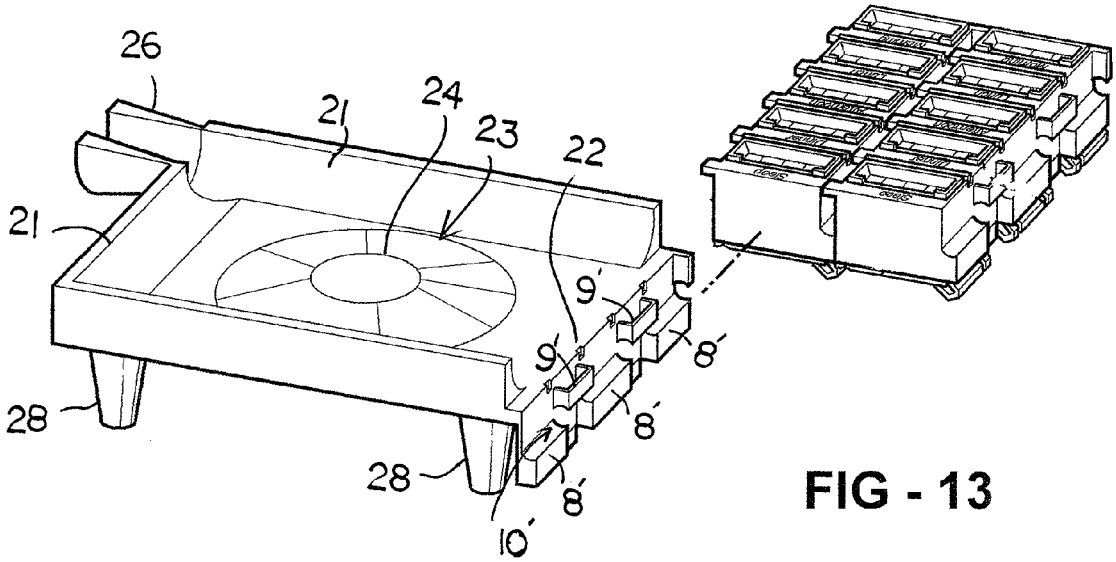
FIGS. 13-16 depict an embodiment of the present invention in which a two-dimensional array of modular pillboxes is coupled to a loading tray.
Figure 14:
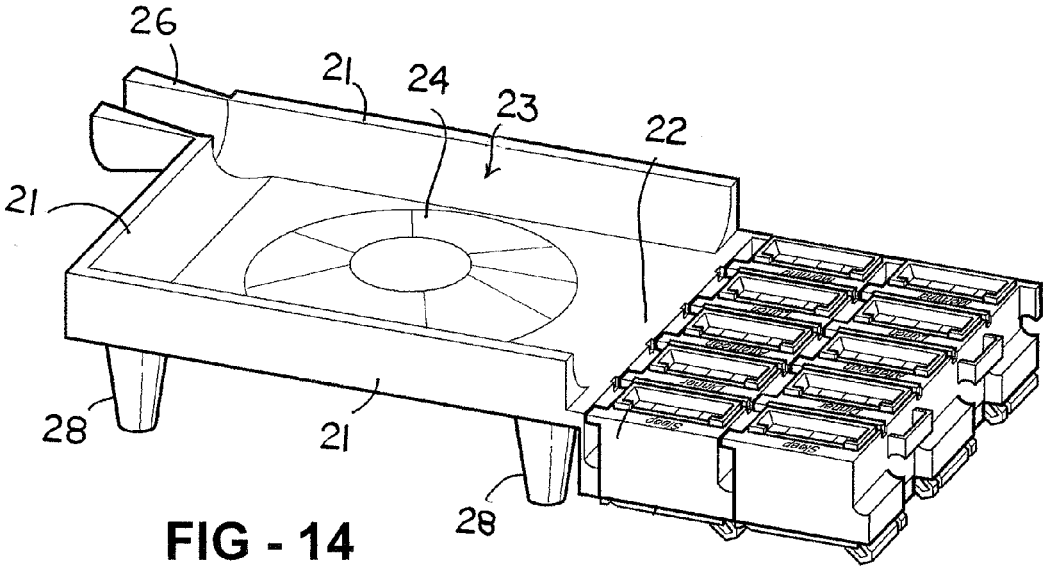
Figure 15:
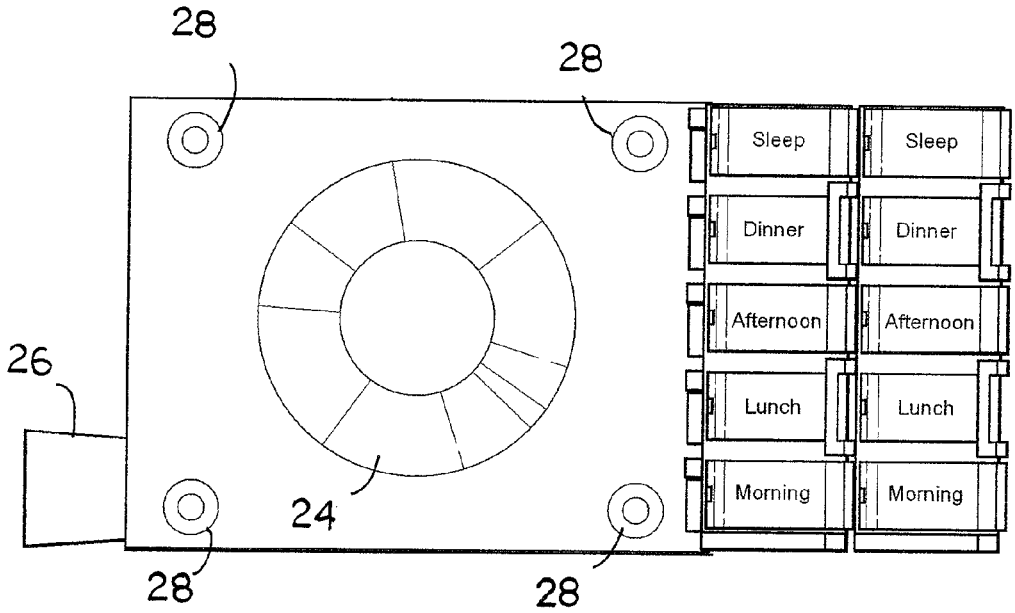
Figure 16:
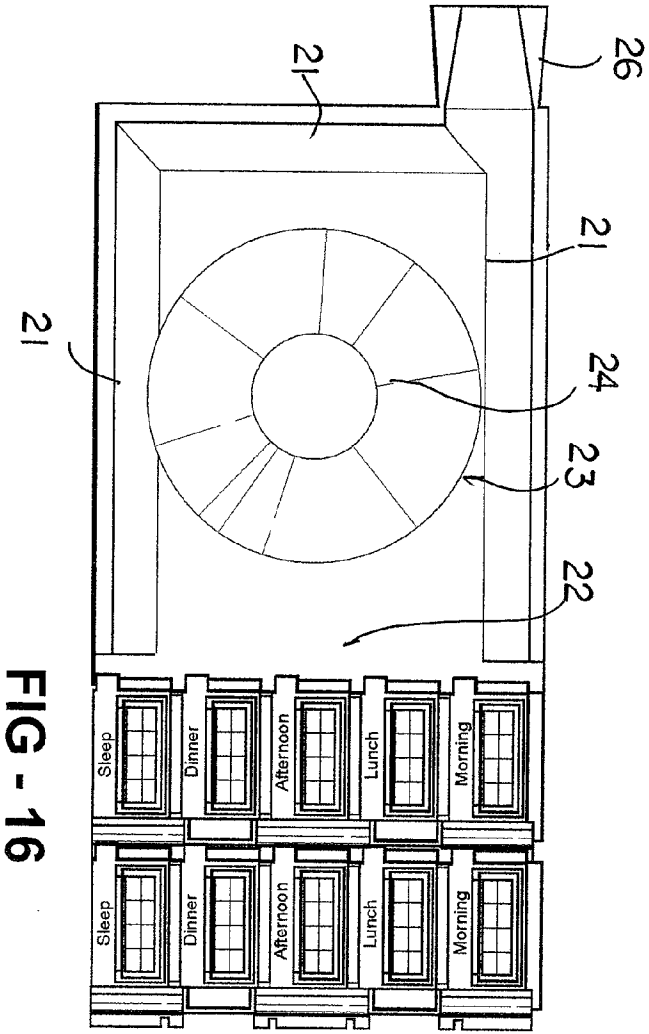

FIGS. 13-16 depict an embodiment of the present invention in which a two-dimensional array of modular pillboxes is coupled to a loading tray. FIG. 13 is a perspective view of a two-dimensional array of modular pillboxes aligned with the coupling structures of a loading tray. FIG. 14 is a perspective view of the two-dimensional array of modular pillboxes coupled to the loading tray. FIG. 15 is a bottom planar view of the two-dimensional array of modular pillboxes coupled to the loading tray. FIG. 16 is a top planar view of the two-dimensional array of modular pillboxes coupled to the loading tray. In the embodiment of the invention shown in FIGS. 13-16 two modular pillboxes similar to that shown in FIG. 1 have been coupled or joined together by their respective coupling structures. This coupling is accomplished by aligning the protrusions 13 provided on the side of one of the modular pillboxes with the groove or channel 10 defined by the projecting structures 8 and 9 on one side of the other modular pillbox and sliding the protrusions 13 into the groove or channel 10. If desired, cooperating stopping structures such as abutments, detent mechanisms, etc. can be provided on the modular pillboxes to prevent the leading edge of one of the modular pillboxes from sliding past the leading edge of the other modular pillbox. Alternatively, pins or clips can be provided to secure the modular pillboxes in a desired location along side each other.

It is noted that the configuration of the coupling structures allows for either a plurality of modular pillboxes to be coupled together before or after coupling a first one of the pillboxes to the loading tray. The modular pillboxes can be coupled to the loading tray before or after being coupled or joined to one another.

Figure 17:
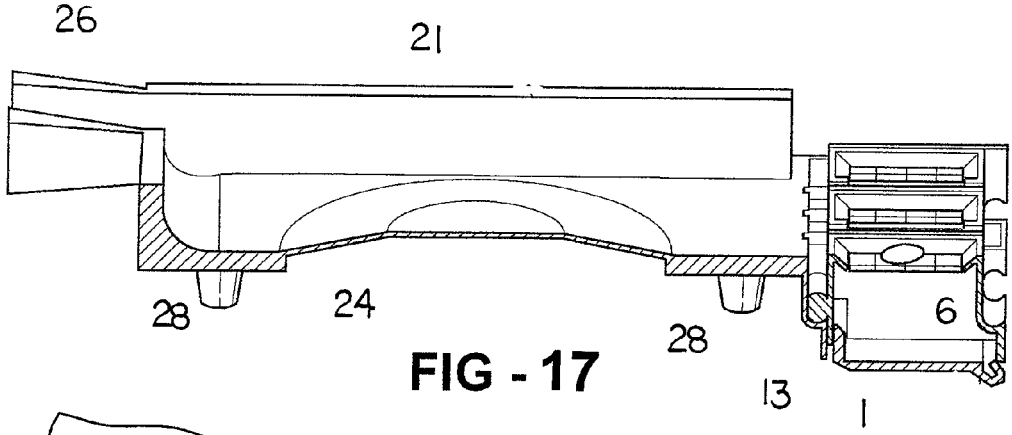
FIG. 17 is a cross-sectional view taken through the loading tray and modular pillbox with the modular pillbox coupled to the loading tray.

FIG. 17 is a cross-sectional view taken through the loading tray and modular pillbox with the modular pillbox coupled to the loading tray. As shown, the bottom surface of the resilient, elastic, deflectable or flexible member is substantially level with the upper surface of the loading deck 22 of the loading tray. This alignment allows materials, pills, articles, etc. to be slid from the loading tray onto the bottoms of the individual interior compartments 1 of the modular pillbox. FIG. 17 also shows how the protrusions 13 provided on the side of one of the modular pillbox are received within the groove or channel 10' defined by the projecting structures 8' and 9' on one side of the loading tray.

Figure 18:
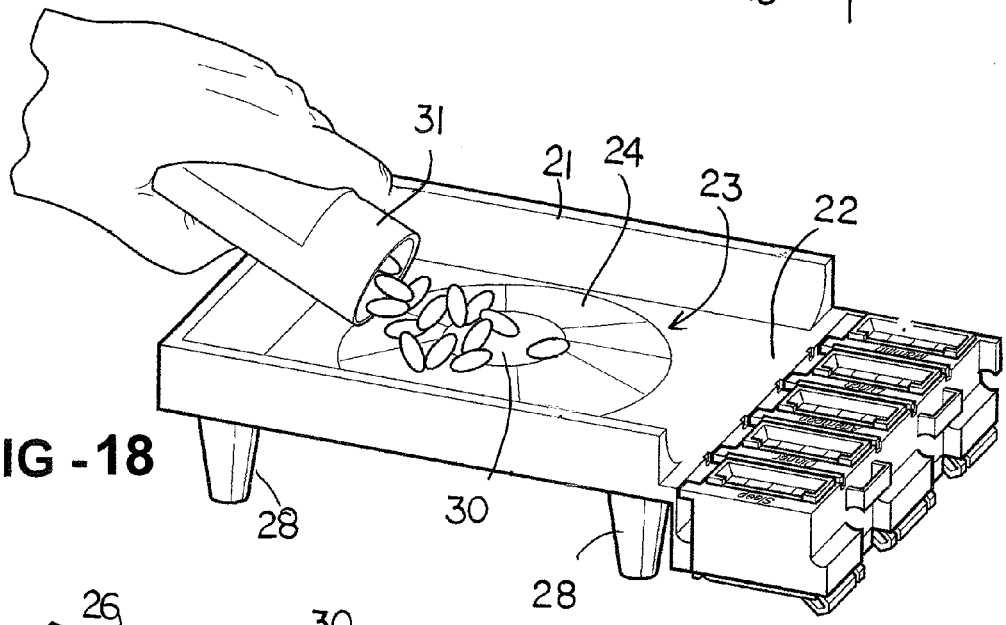
FIGS. 18-27 are a series of figures which depict how the loading tray can be used to load pills into the modular pill boxes.
Figure 19:
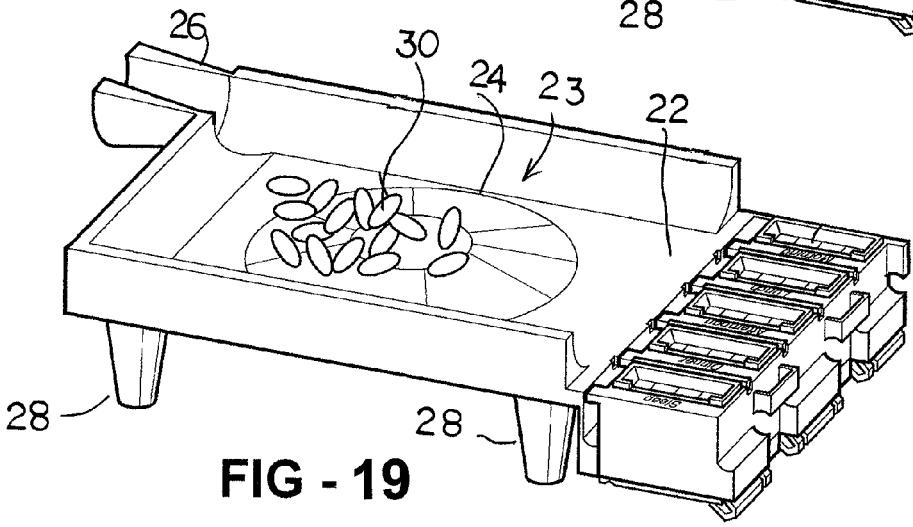
Figure 20:
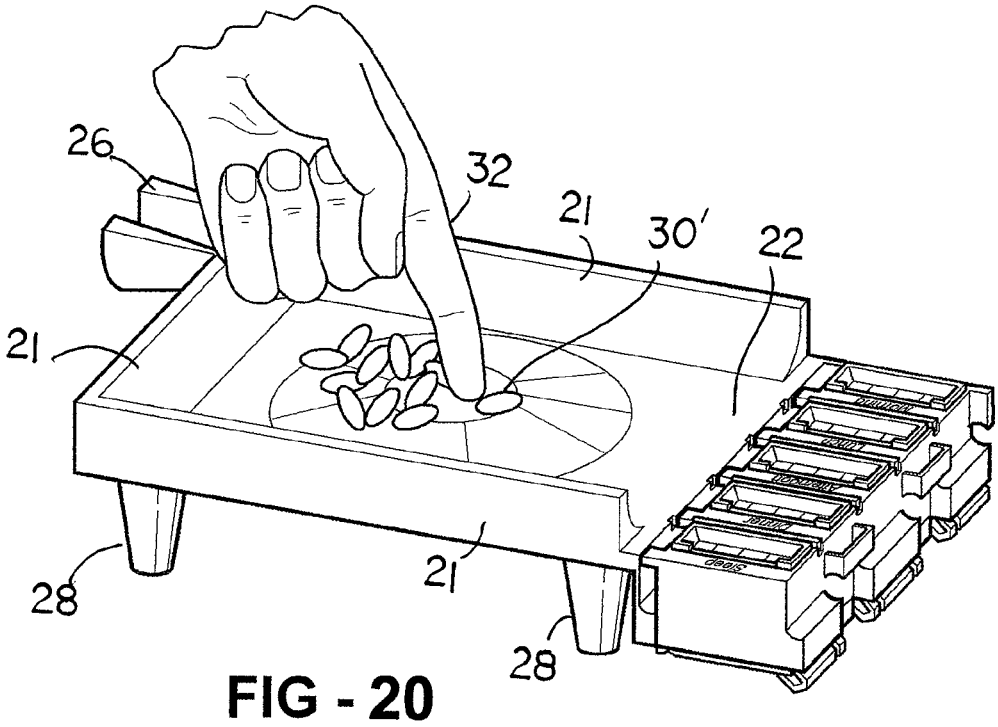
Figure 21:
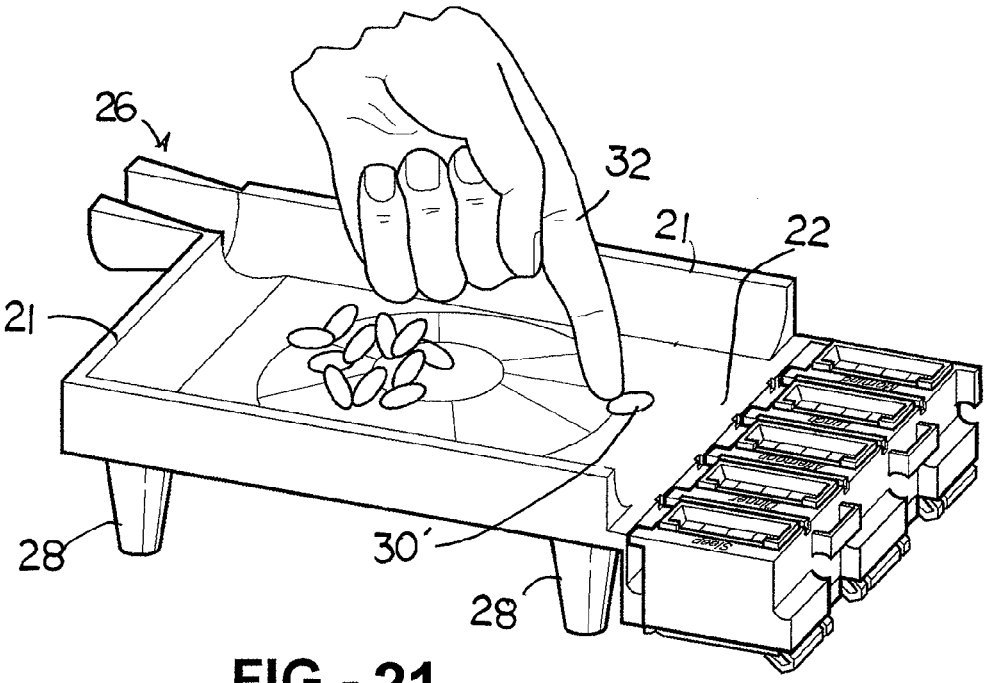
Figure 22:
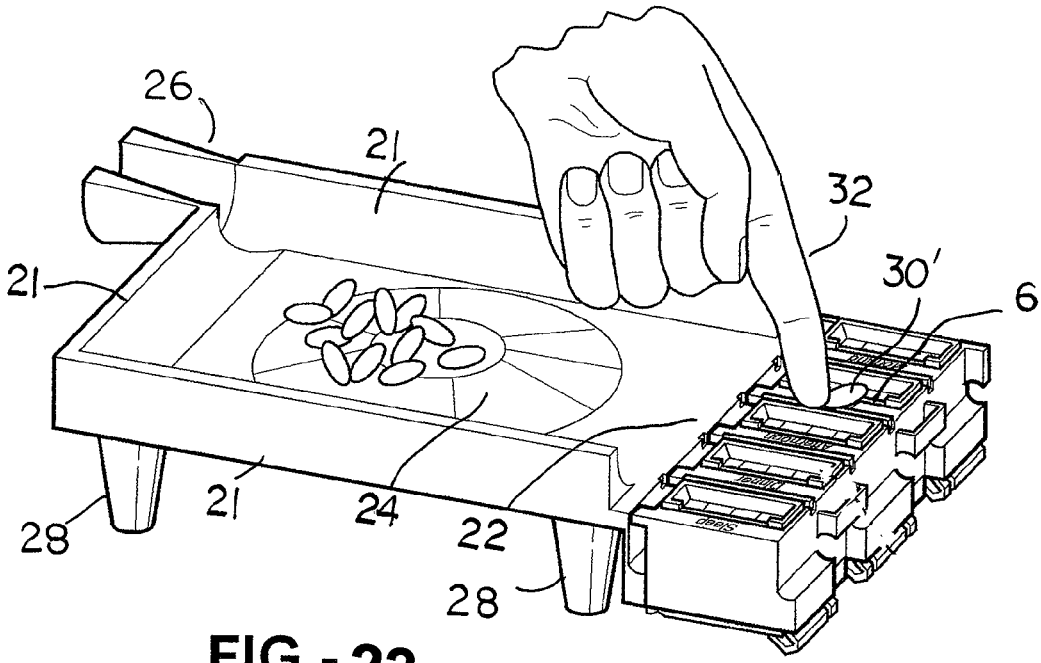
Figure 23:
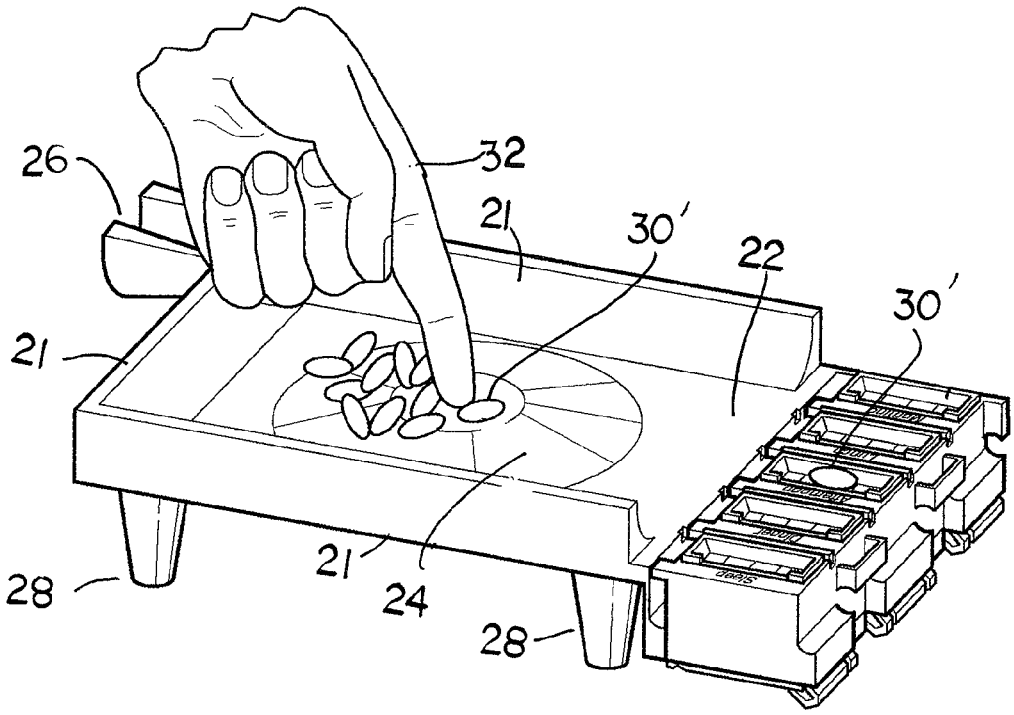
Figure 24:
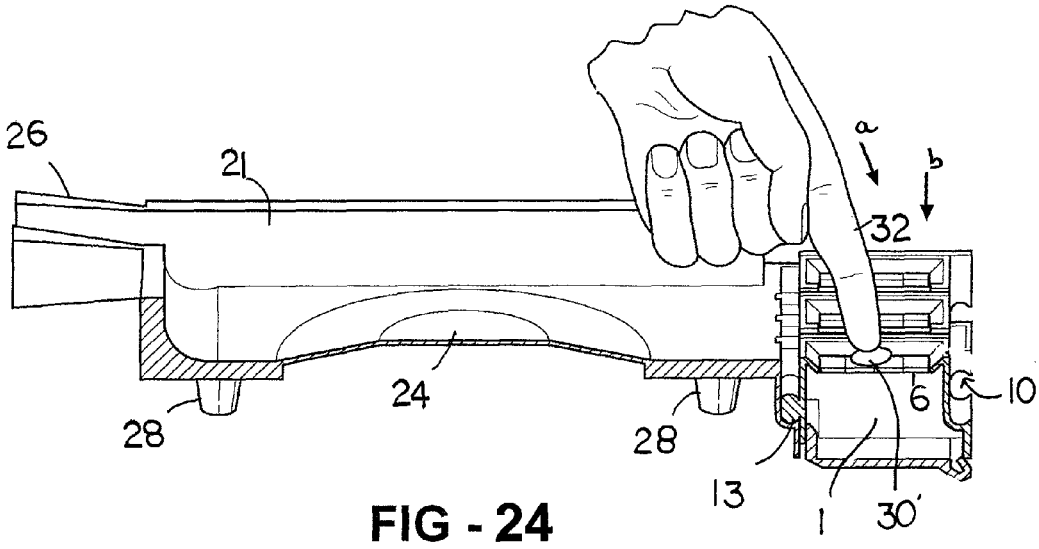
Figure 25:
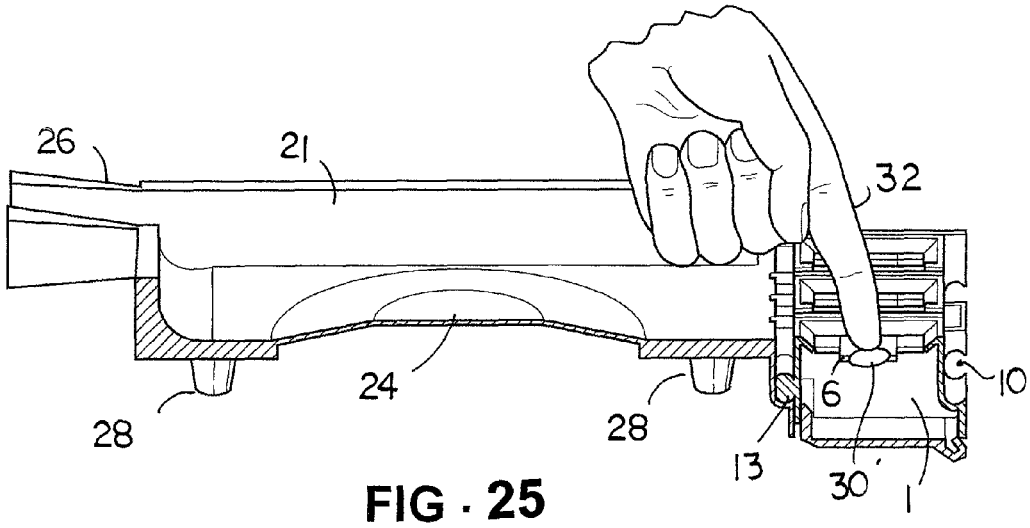
Figure 26:
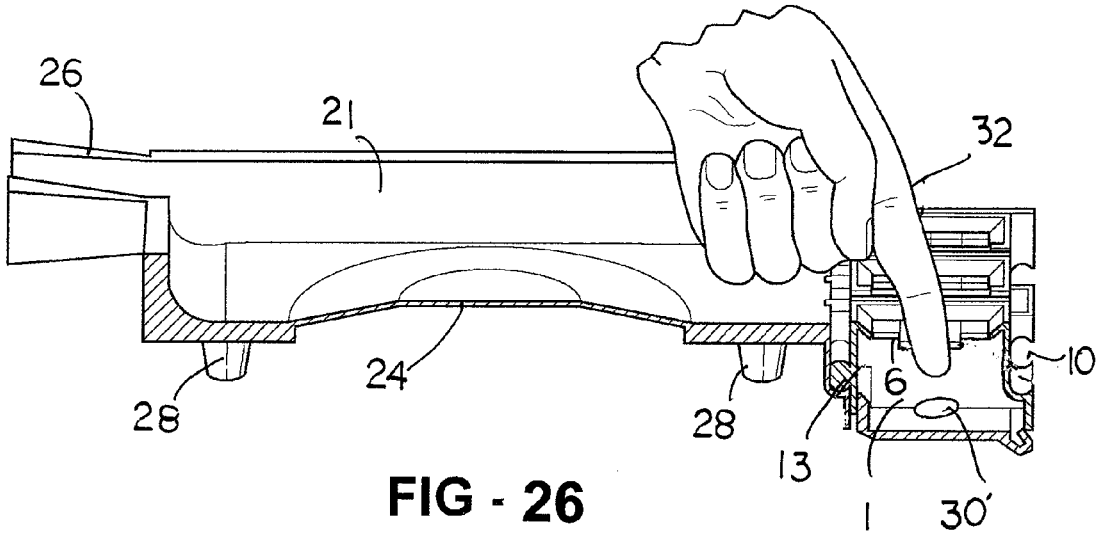
Figure 27:
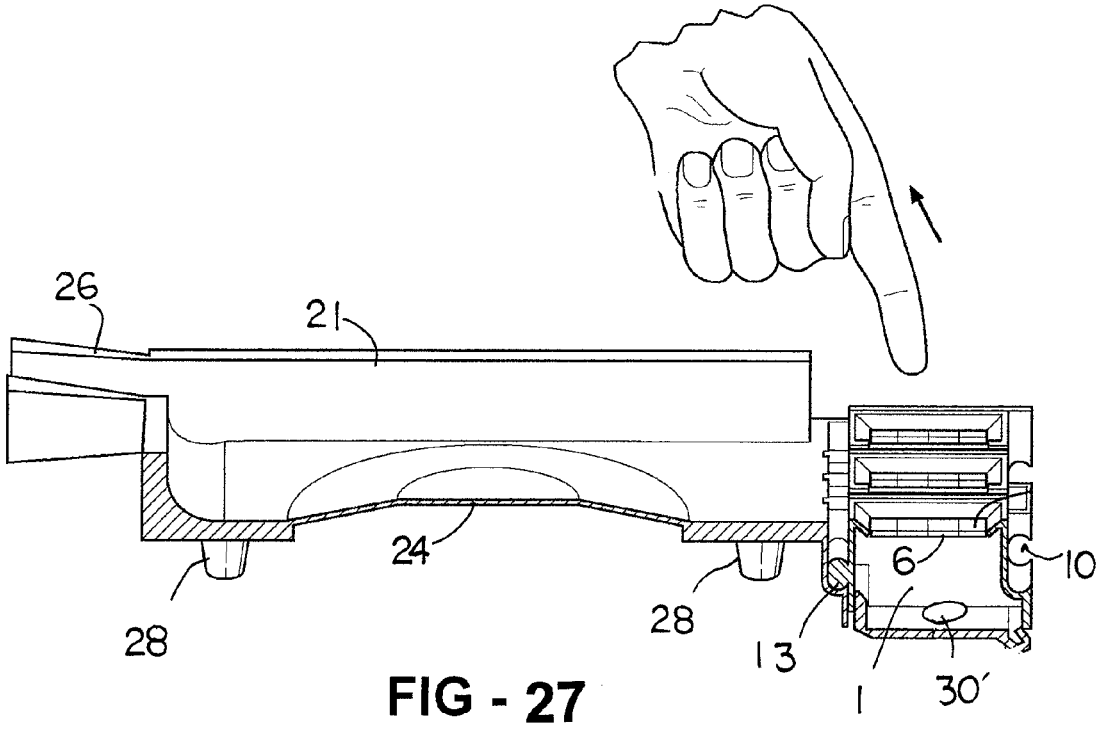

FIGS. 18-27 are a series of figures which depict how the loading tray can be used to load pills into the modular pill boxes. As shown in FIG. 18, articles, such as pills 30 are poured out of a container 31 onto the upper surface of the loading tray. A desired pill 30' is selected and pushed by an operator's finger 32 or other probe across the upper surface of the loading tray (FIGS. 20-21) and over the bottom surface of the resilient, elastic, deflectable or flexible member 6 of one of the interior compartments 1 of the modular pillboxes (FIGS. 22-23). Next, the pill 30' that is positioned over the bottom surface of the resilient, elastic, deflectable or flexible member 6 of one of the interior compartments 1 of the modular pillboxes is pushed downward through the resilient, elastic, deflectable or flexible member 6 and into the underlying interior compartment 1 (FIGS. 24-27). In order to position the pills on the resilient, elastic, deflectable or flexible members 6, the resilient, elastic, deflectable or flexible members 6 can be provided with a concave shape or recessed as desired. As pills are being loaded into the different interior compartments 1 of the modular pillboxes, the indicia 5 provided on the support surfaces 4 will identify the proper interior chamber 1 to the person loading the pills. In the case in which the indicia 5 has raised features, it can provide a higher friction area which will help prevent pills from sliding over an adjacent resilient, elastic, deflectable or flexible member 6. Depending on the configuration of the resilient, elastic, deflectable or flexible member 6, the force to push the pill therethrough may have to be applied at a slight angle as shown by arrow "a" in FIG. 26 (arrow "b" is normal to the surface of the resilient, elastic, deflectable or flexible member 6). FIG. 26 depicts how flaps 33 formed from cuts or slits in the resilient, elastic, deflectable or flexible member 6 are deflected so as to open and allow a pill to be pushed therethrough.

Figure 28:
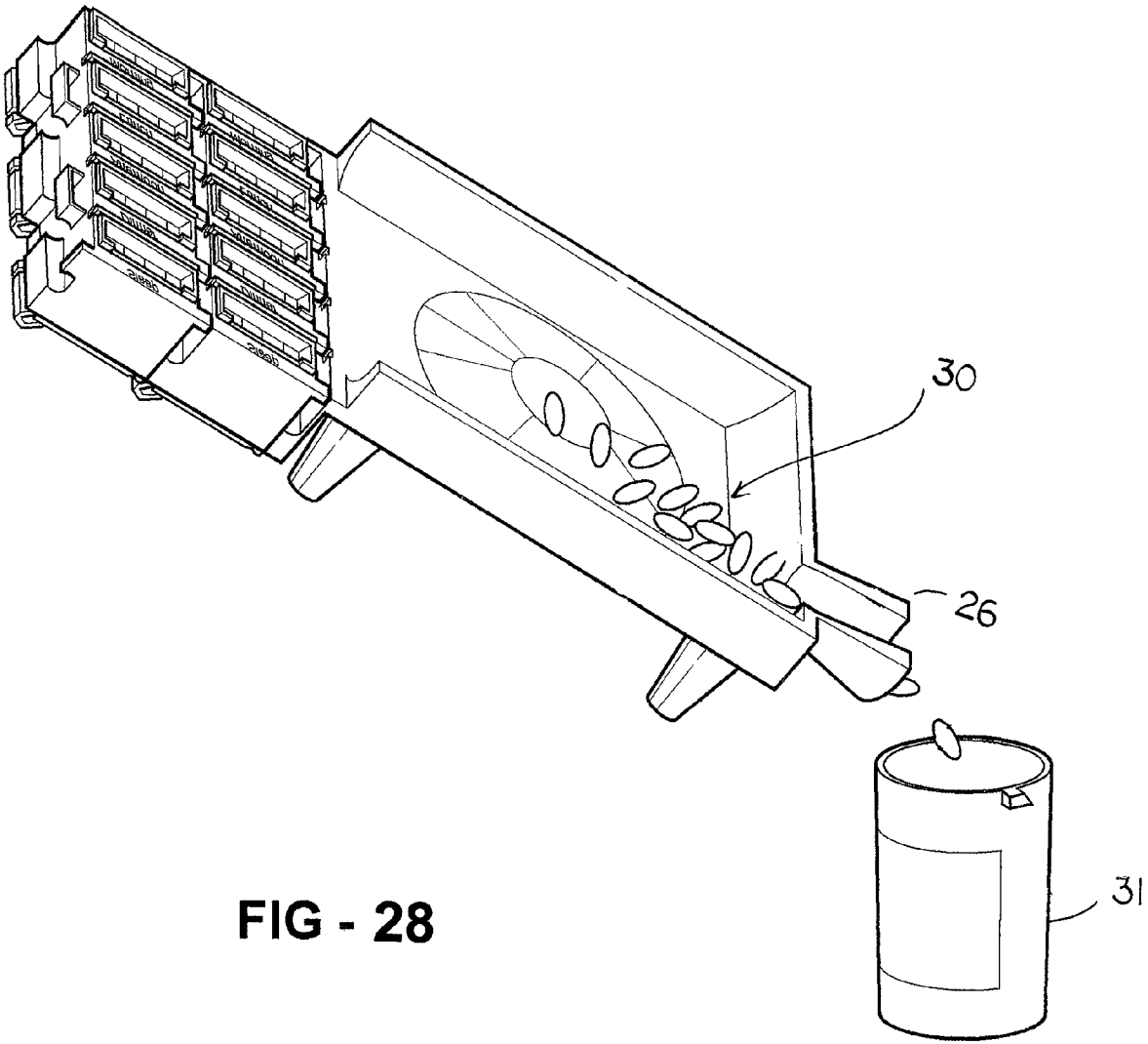
FIG. 28 depicts how the funnel of the loading tray can be used to dispense extra pills back into a medicine bottle.

FIG. 28 depicts how the funnel of the loading tray can be used to dispense extra pills back into a medicine bottle. As shown in FIG. 28, materials, pills or articles that remain on the surface of the loading tray after the modular pillboxes are loaded can be returned to a container 31 by tilting the loading tray so that the funnel 26 is at the lowest position and aligned over the mouth of container 31. Slight shaking and/or further tilting of the loading tray will result in the extra pills 30 falling into the container 31 where they can be stored until the next time the modular pillboxes are loaded.

FIG. 29 depicts how a magnifying lens provided in the loading tray can be used to read a label of a medicine bottle. In the embodiment of the loading tray that includes a magnifying lens 24, at least the magnifying lens 24 portion of the loading tray is transparent. The magnifying lens 24 can be to read labels of medicine bottles or other labels, instructions, warnings, etc. by holding the magnifying lens within one's line of sight with such labels as exemplified by the label 34 of the medicine container 31 in FIG. 29.

Figure 31:
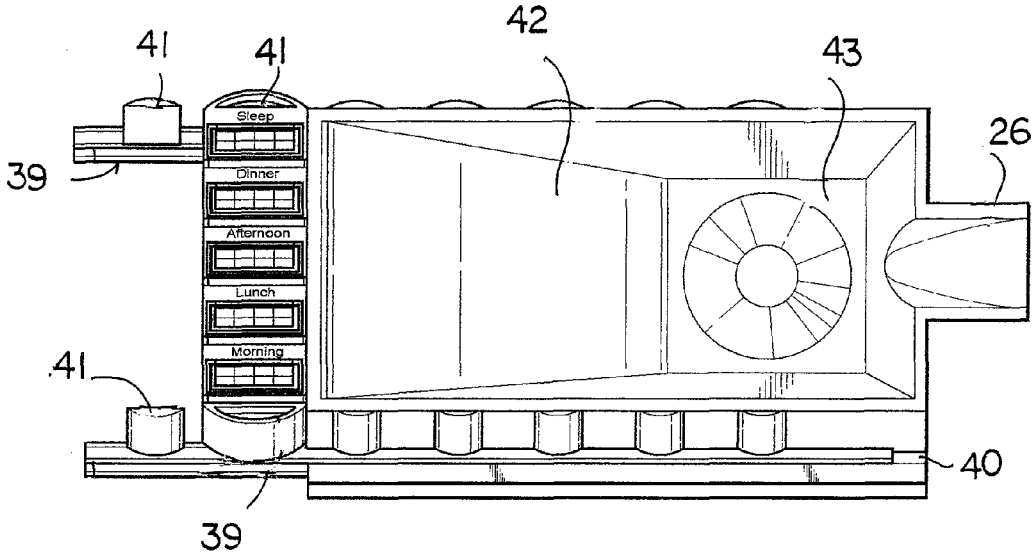
FIG. 31 depicts a loading tray that is configured to be coupled to the modular pillbox of FIG. 30.

FIG. 31 depicts the bottom of a modular pillbox that includes a linear array of five pill compartments. The modular pillbox depicted in FIG. 30 includes coupling structures 36 on each end. These coupling structures 35 are configured to cooperate with compatible coupling structures provided on a rail system of a loading tray. The coupling structures 35 shown in FIG. 32 include wall a straight wall 36' and a curved wall 37 that define a particularly shaped cavity 38 therebetween.

FIG. 31 depicts a loading tray that is configured to be coupled to the modular pillbox of FIG. 30. The loading tray shown in FIG. 31 include a rail system that comprises a rails 39 on opposite sides of the loading tray that can slide outward with respect to the loading deck 22 of the loading tray along grooves or channels 40. Each of the rails 39 includes a plurality of protrusions 41 that extend upward and are complementarily shaped to the cavities 38 provided on the opposite ends of the modular pillboxes of FIG. 30. As shown in FIG. 31, with the rails 39 slid outward from the loading deck 22 of the loading tray, a modular pillbox can be supported on the rails 39 by positioning the cavities 38 over the protrusions 41 so that the protrusions 41 are received in the cavities 38 and the modular pillbox is thus supported and on the rail system in proper alignment with the loading deck 22.

Figure 32:
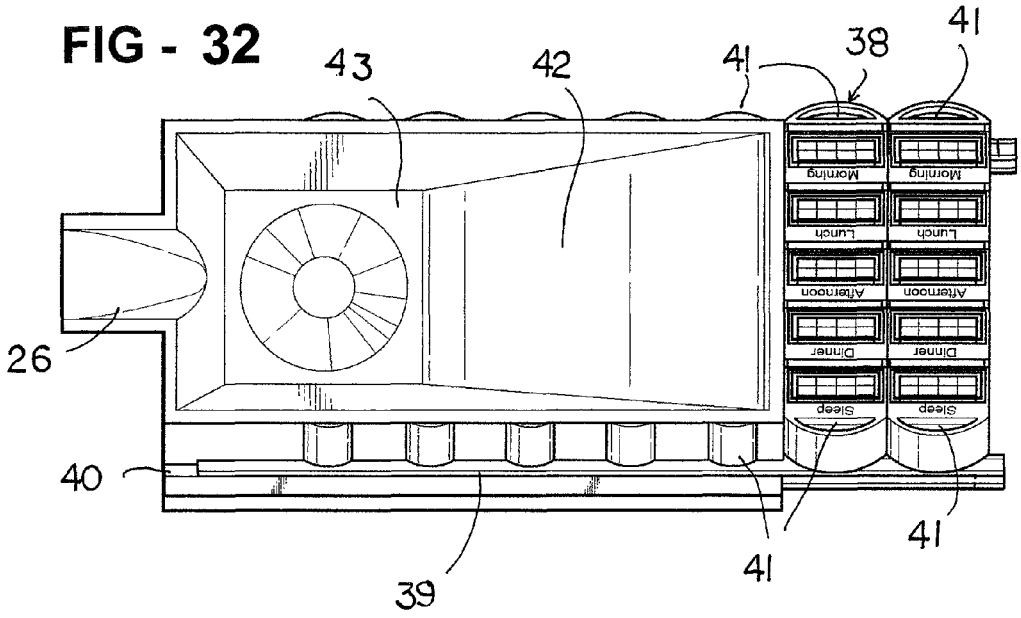
FIG. 32 depicts the loading tray of FIG. 30 arranged to be coupled to a plurality of the modular pillboxes of FIG. 30.

FIG. 32 depicts the loading tray of FIG. 30 arranged to be coupled to a plurality of the modular pillboxes of FIG. 30. FIG. 3 depicts how two or more modular pillboxes can be supported on the rail system of the loading tray. As shown, the rails 39 can be extended beyond the loading deck 2 so that two or more projections 41 on each rail 39 are available for receiving modular pillboxes thereon.

It is noted that in FIGS. 31 and 32 the loading tray has the funnel 26 in a middle portion of side rather than having the funnel 26 extend from a corner as in the embodiment shown in FIG. 6. Also the loading tray shown in FIGS. 31 and 32 has a surface 42 that slopes downward to a lower bottom portion 43 in which the magnifying lens 24 is provided. The alternative embodiment of the loading tray shown in FIGS. 31 and 32 is merely one example of different configurations that the loading tray can employ.

The modular pillboxes and loading trays of the present invention can be made from any suitable materials, including plastics. The resilient, elastic, deflectable or flexible member, can be made from various materials such as plastics, polymers, elastomers, metals, etc.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A modular pillbox which comprises a housing having at least one interior compartment defined by a top, an openable lid which closes the top, a bottom that comprises a one-way passage through which pills can be pushed into the interior compartment, and sidewalls.

2. A modular pillbox according to claim 1, wherein the one-way passage comprises one of a resilient member, an elastic member, a deflectable member or a flexible member.

3. A modular pillbox according to claim 2, wherein the one-way passage comprises at least one slit therein.

4. A modular pillbox according to claim 1, wherein at least one sidewall of the modular pillbox comprises coupling structure that is configured to couple the modular pillbox to another modular pill box.

5. A modular pillbox according to claim 4, wherein opposite ones of the sidewalls of the modular pillbox comprises coupling structure that are configured to couple the modular pillbox to other modular pillboxes.

6. A modular pillbox according to claim 1, wherein the at least one interior compartment comprises two or more interior compartments and the sidewalls comprise internal sidewalls between adjacent interior compartments and exterior sidewalls that extend around the periphery of the modular pillbox.

7. A modular pillbox and loading system that comprises: at least one modular pillbox which comprises a housing having at least one interior compartment defined by a top, an openable lid which closes the top, a bottom that comprises a one-way passage through which pills can be pushed into the interior compartment, and sidewalls, and a loading tray having a loading deck, the at least one modular pillbox and the loading tray including coupling structure by which the at least one modular pillbox can be coupled to the loading tray immediately adjacent to the loading deck with the one-way passage facing upward.

8. A modular pillbox and loading system according to claim 7, wherein the one-way passage comprises one of a resilient member, an elastic member, a deflectable member or a flexible member.

9. A modular pillbox and loading system according to claim 8, wherein the one-way passage comprises at least one slit therein.

10. A modular pillbox and loading system according to claim 7, wherein at least one sidewall of the modular pillbox comprises coupling structure that is configured to couple the modular pillbox to another modular pill box.

11. A modular pillbox and loading system according to claim 7, wherein the at least one interior compartment comprises two or more interior compartments and the sidewalls comprise internal sidewalls between adjacent interior compartments and exterior sidewalls that extend around the periphery of the modular pillbox.

12. A modular pillbox and loading system according to claim 7, wherein the loading tray further comprises a magnifying lens.

13. A modular pillbox and loading system according to claim 7, wherein the loading tray further comprises a funnel.

14. A modular pillbox and loading system according to claim 7, wherein the loading tray comprises rails that can be extended beyond the loading deck to couple the at least one modular pillbox upside down to the loading tray immediately adjacent to the loading deck.

15. A modular pillbox and loading system according to claim 7, wherein the rails are configured to couple the at least one modular pillbox upside down to the loading tray immediately adjacent to the loading deck and another modular pillbox adjacent the at least one modular pillbox.

16. A modular pillbox and loading system according to claim 7, wherein the rails can be slidably extended beyond the loading deck.

17. A method of loading pills into a pillbox which comprises: providing a pillbox that has an interior compartment, an openable lid and a one-way passage through which pills can be pushed into the interior compartment; positioning a pill on the one-way passage; and pushing the pill through the one-way passage and into the interior compartment.

18. A method of loading pills into a pillbox according to claim 17, wherein the pillbox comprises a plurality of interior compartments.

19. A method of loading pills into a pillbox according to claim 17, further comprising: providing a loading tray; coupling the pillbox to the loading tray; dispensing at least one pill on the loading tray; transferring the at least on pill from the loading tray to a position over the one-way passage; and pushing the pill through the one-way passage and into the interior compartment.

20. A method of loading pills into a pillbox according to claim 19, wherein the pillbox has a plurality of interior compartments and a plurality of one-way passages and the method comprises: dispensing a plurality of pills on the loading tray; transferring the at least on pill from the loading tray to a position over two or more of the one-way passages; and pushing the pill through the two or more one-way passages and into the underlying interior compartments.

* * * * *